US006070642A

United States Patent [19]

Douglas et al.

[11] Patent Number: 6,070,642

[45] Date of Patent: Jun. 6, 2000

[54] PROTECTIVE ROLLER SCREEN ASSEMBLY

[76] Inventors: George Douglas; June Douglas, both of 969 Carroll B-24, Brooklyn, N.Y. 11225

[21] Appl. No.: 09/224,318

[22] Filed: Dec. 31, 1998

[51] Int. Cl.[7] ..... A47G 5/02

[52] U.S. Cl. ..... 160/310; 160/290.1

[58] Field of Search ..... 160/31, 98, 310, 160/311, 290.1, 271, 273.1, 264, DIG. 7, 274

[56] References Cited

U.S. PATENT DOCUMENTS

| | | | |
|---|---|---|---|
| 503,037 | 8/1893 | Crisson | 160/274 |
| 1,395,475 | 11/1921 | Bried | 160/290.1 X |
| 1,677,230 | 7/1928 | Mercurio | 160/273.1 |
| 1,791,548 | 2/1931 | Zucca | 160/273.1 |
| 2,025,630 | 12/1935 | Yartyan | 160/31 |
| 2,035,146 | 3/1936 | Deinzer | 160/31 X |
| 2,284,052 | 5/1942 | Heckman et al. | 160/31 |
| 2,517,514 | 8/1950 | Walsh | 160/31 |
| 4,480,676 | 11/1984 | Solomon | 160/290.1 X |
| 5,081,402 | 1/1992 | Koleda | 160/310 X |
| 5,198,974 | 3/1993 | Orsat | 160/310 X |
| 5,848,634 | 12/1998 | Will et al. | 160/310 |

*Primary Examiner*—David M. Purol

[57] ABSTRACT

A protective roller screen assembly for helping prevent projectiles moving at a high velocity from passing through a window or doorway. The protective roller screen assembly includes a frame that has a pair of upright members, an upper cross member that extends between upper ends of the upright members, and a lower cross member that extends between lower ends of the upright members. Each of the upright members has inner and outer sides, front and back sides, and an interior that is defined between the sides. Each of the inner sides of the upright members has a guide slot extending therethrough between the upper and lower ends of the upright members. A screen extends downwardly from the upper cross member. Opposed side ends of the screen are slidably disposed in the guide slots of the upright members. The screen is positionable between an extended position and a retracted position. The bottom end of the screen is positioned towards the lower cross member when the screen is positioned in the extended position. The bottom end of the screen is positioned towards the upper cross member when the screen is positioned in the retracted position.

2 Claims, 3 Drawing Sheets

PROTECTIVE ROLLER SCREEN ASSEMBLY

BACKGROUND OF THE INVENTION

1. Field of the Invention

The present invention relates to screen assemblies and more particularly pertains to a new protective roller screen assembly for helping prevent projectiles moving at a high velocity from passing through a window or doorway.

2. Description of the Prior Art

The use of screen assemblies is known in the prior art. More specifically, screen assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,862,942; U.S. Pat. No. 3,974,313; U.S. Pat. No. Design 356,644; U.S. Pat. No. 1,960,434; U.S. Pat. No. 3,126,052; and U.S. Pat. No. 4,651,797.

While these devices fulfill their respective, particular objectives and requirements, the aforementioned patents do not disclose a new protective roller screen assembly. The inventive device includes a frame that has a pair of upright members, an upper cross member that extends between upper ends of the upright members, and a lower cross member that extends between lower ends of the upright members. Each of the upright members has inner and outer sides, front and back sides, and an interior that is defined between the sides. Each of the inner sides of the upright members has a guide slot extending therethrough between the upper and lower ends of the upright members. A screen extends downwardly from the upper cross member. Opposed side ends of the screen are slidably disposed in the guide slots of the upright members. The screen is positionable between an extended position and a retracted position. The bottom end of the screen is positioned towards the lower cross member when the screen is positioned in the extended position. The bottom end of the screen is positioned towards the upper cross member when the screen is positioned in the retracted position.

In these respects, the protective roller screen assembly according to the present invention substantially departs from the conventional concepts and designs of the prior art, and in so doing provides an apparatus primarily developed for the purpose of helping prevent projectiles moving at a high velocity from passing through a window or doorway.

SUMMARY OF THE INVENTION

In view of the foregoing disadvantages inherent in the known types of screen assemblies now present in the prior art, the present invention provides a new protective roller screen assembly construction wherein the same can be utilized for helping prevent projectiles moving at a high velocity from passing through a window or doorway.

The general purpose of the present invention, which will be described subsequently in greater detail, is to provide a new protective roller screen assembly apparatus and method which has many of the advantages of the screen assemblies mentioned heretofore and many novel features that result in a new protective roller screen assembly which is not anticipated, rendered obvious, suggested, or even implied by any of the prior art screen assemblies, either alone or in any combination thereof.

To attain this, the present invention generally comprises a frame that has a pair of upright members, an upper cross member that extends between upper ends of the upright members, and a lower cross member that extends between lower ends of the upright members. Each of the upright members has inner and outer sides, front and back sides, and an interior that is defined between the sides. Each of the inner sides of the upright members has a guide slot extending therethrough between the upper and lower ends of the upright members. A screen extends downwardly from the upper cross member. Opposed side ends of the screen are slidably disposed in the guide slots of the upright members. The screen is positionable between an extended position and a retracted position. The bottom end of the screen is positioned towards the lower cross member when the screen is positioned in the extended position. The bottom end of the screen is positioned towards the upper cross member when the screen is positioned in the retracted position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective roller screen assembly apparatus and method which has many of the advantages of the screen assemblies mentioned heretofore and many novel features that result in a new protective roller screen assembly which is not anticipated, rendered obvious, suggested, or even implied by any of the prior art screen assemblies, either alone or in any combination thereof.

It is another object of the present invention to provide a new protective roller screen assembly which may be easily and efficiently manufactured and marketed.

It is a further object of the present invention to provide a new protective roller screen assembly which is of a durable and reliable construction.

An even further object of the present invention is to provide a new protective roller screen assembly which is susceptible of a low cost of manufacture with regard to both materials and labor, and which accordingly is then susceptible of low prices of sale to the consuming public, thereby making such protective roller screen assembly economically available to the buying public.

Still yet another object of the present invention is to provide a new protective roller screen assembly which provides in the apparatuses and methods of the prior art some of the advantages thereof, while simultaneously overcoming some of the disadvantages normally associated therewith.

Still another object of the present invention is to provide a new protective roller screen assembly for helping prevent projectiles moving at a high velocity from passing through a window or doorway.

Yet another object of the present invention is to provide a new protective roller screen assembly which includes a frame that has a pair of upright members, an upper cross member that extends between upper ends of the upright members, and a lower cross member that extends between lower ends of the upright members. Each of the upright members has inner and outer sides, front and back sides, and an interior that is defined between the sides. Each of the inner sides of the upright members has a guide slot extending therethrough between the upper and lower ends of the upright members. A screen extends downwardly from the upper cross member. Opposed side ends of the screen are slidably disposed in the guide slots of the upright members. The screen is positionable between an extended position and a retracted position. The bottom end of the screen is positioned towards the lower cross member when the screen is positioned in the extended position. The bottom end of the screen is positioned towards the upper cross member when the screen is positioned in the retracted position.

Still yet another object of the present invention is to provide a new protective roller screen assembly that helps prevent intruders from gaining illegal entry into a home or another building.

Even still another object of the present invention is to provide a new protective roller screen assembly that provides more protection from intrusion by intruders or projectiles than conventional metal bars.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
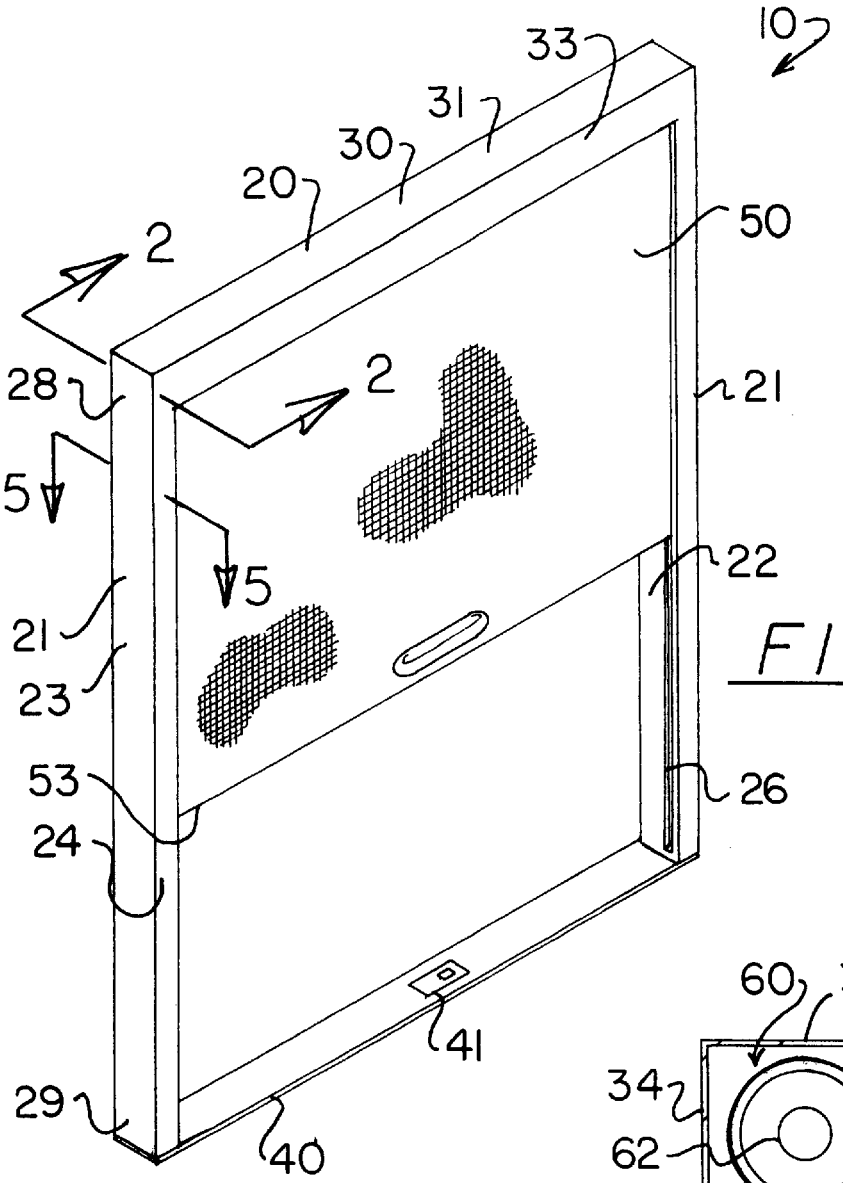
FIG. 1 is a schematic perspective view of a new protective roller screen assembly according to the present invention.
Figure 2:
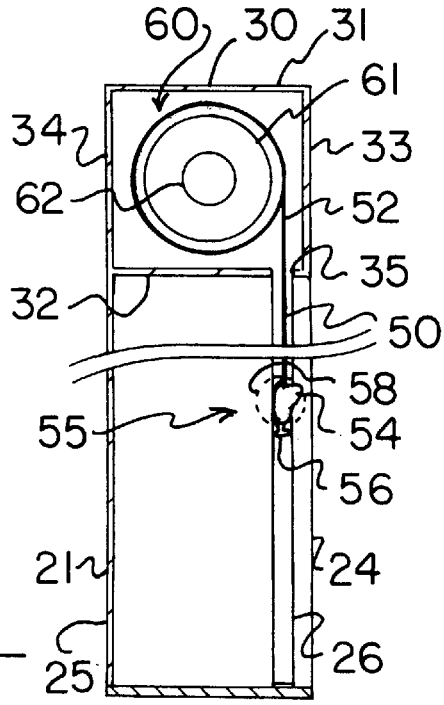
FIG. 2 is a schematic cross sectional view of the present invention taken from line 2—2 of FIG. 1.

With reference now to the drawings, and in particular to FIGS. 1 through 6 thereof, a new protective roller screen assembly embodying the principles and concepts of the present invention and generally designated by the reference numeral 10 will be described.

As best illustrated in FIGS. 1 through 6, the protective roller screen assembly 10 generally comprises a frame 20 that is preferably generally rectangular and has a pair of upright members 21, an upper cross member 30 that extends between upper ends of the upright members 21, and a lower cross member 40 that extends between lower ends of the upright members 21. Each of the upright members 21 has inner and outer sides 22,23, front and back sides 24,25, and an interior that is defined between the sides. Each of the inner sides 22 of the upright members 21 has a guide slot extending therethrough between upper and lower ends 28,29 of each of the upright members 21. A screen 50 extends downwardly from the upper cross member 30. Opposed side ends 51 of the screen 50 are slidably disposed in the guide slots 26 of the upright members 21. The screen 50 is positionable between an extended position and a retracted position. The bottom end 53 of the screen 50 is positioned towards the lower cross member 40 when the screen 50 is positioned in the extended position. The bottom end 53 of the screen 50 is positioned towards the upper cross member 30 when the screen 50 is positioned in the retracted position.

Preferably, each of the upright members 21 has inner and outer sides 22,23, front and back sides 24,25, and an interior that is defined between the sides. Each of the inner sides 22 of the upright members 21 has a guide slot extending therethrough between the upper and lower ends 28,29 of the upright members 21. Each of the guide slots 26 is positioned towards the front sides 24 of the upright members 21. It should be noted that though the naming of the upright members 21 suggests a vertical orientation, the screen assembly may be rotated 90 or 180 degrees and utilized in the same manner as herein described.

Also preferably, the screen 50 is flexible and comprises a projectile energy absorbing material. More preferably, the material comprises interwoven high strength synthetic fibers such as the fibers produced under the trade name KEVLAR. Ideally, the material has enough strength to provide protection against rocks and other thrown objects, as well as non armor-piercing ammunition. The screen may be painted or decorated to match the deco of a room. For example, the screen may be decorated with animals and favorite cartoon characters when used in a child's room.

Preferably, the bottom end 53 of the screen 50 has a handle 54 coupled to it for manually positioning the screen 50 between the extended and retracted positions. The bottom end 53 of the screen 50 has a latch mechanism 55 coupled to it for latching to the lower cross member 40 to lock the screen 50 in an extended position. The latch mechanism 55 has a hook 56 extending from it. The lower cross member 40 has a flange 41. The hook 56 of the latch mechanism 55 selectively engages the flange 41 of the lower cross member 40 for latching the screen 50 to the lower cross member 40.

Also preferably, the upper cross member 30 has top and bottom sides 31,32, forward and rearward sides 33,34, and an interior that is defined between the sides. The bottom side 32 of the upper cross member 30 has a lower slot 35 extending therethrough between opposite ends thereof. The lower slot 35 is positioned towards the forward side 33 of the upper cross member 30 and generally aligned with the guide slots 26 of the upright members 21. The screen 50 slidably extends through the lower slot 35.

A retracting mechanism 60 is disposed in the upper cross member 30. The retracting mechanism 60 is for storing the screen 50 in a wrapped orientation when the screen 50 is in the retracted position as well as for positioning the screen 50 between the extended and retracted positions. More preferably, the retracting mechanism 60 comprises a generally cylindrical spool 61 rotatably disposed in the upper cross member 30 such as by being rotatably coupled to the opposed ends of the upper cross member 30 or by means of an axle 62 extending between the opposed ends of the upper cross member 30 and disposed in a lumen of the spool 61. The top end 52 of the screen 50 is coupled to the spool 61. The screen 50 wraps around the spool 61 as the screen 50 moves from an extended position towards a retracted position. The spool 61 is rotatable in a first direction and a second direction. The spool 61 moves in the first direction as the screen 50 moves towards an extended position. The spool 61 moves in a second direction as the spool 61 moves towards a retracted position. Ideally, the spool 61 is biased towards the second direction.

Figure 3:
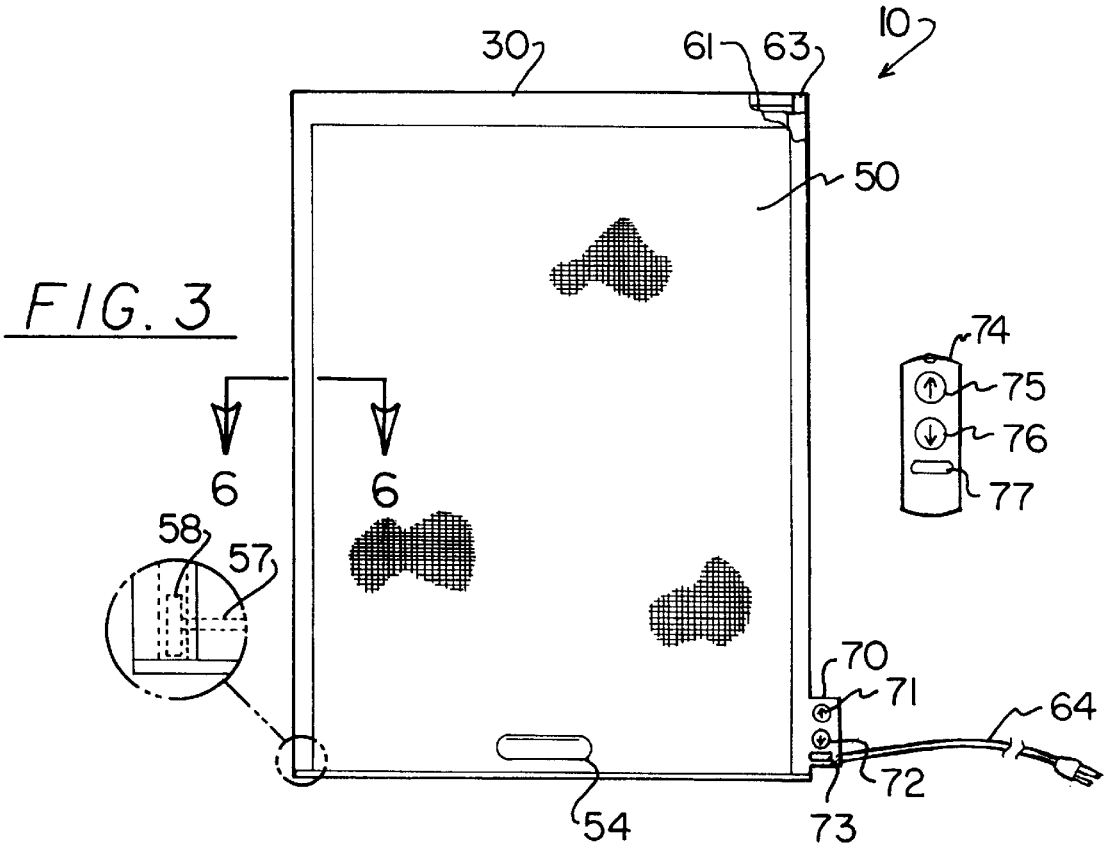
FIG. 3 is a schematic side view of the present invention.
Figure 4:
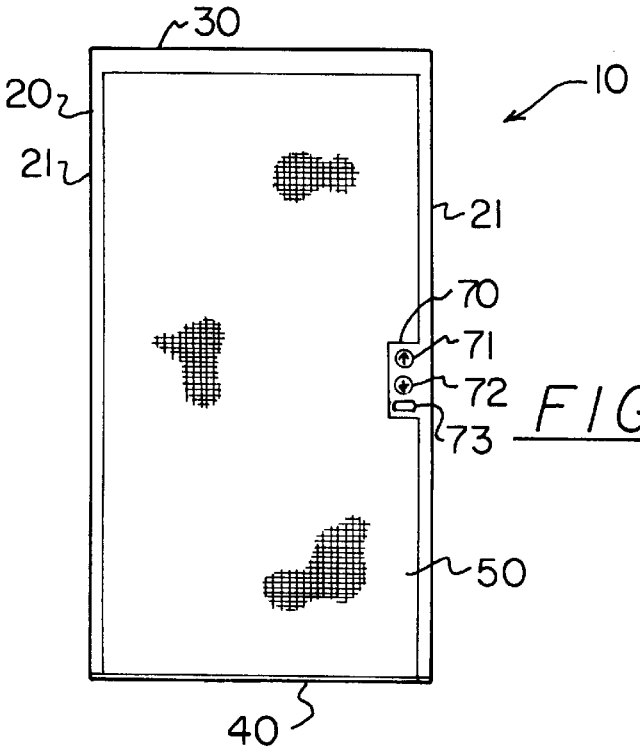
FIG. 4 is a schematic side view of an alternate embodiment of the present invention.

Ideally, as shown in FIG. 3, the retracting mechanism 60 further comprises a motor 63 that is operatively coupled to the spool 61. The motor 63 rotates the spool 61 in the first and second directions. Most ideally, the motor 63 permits free rotation of the spool 61 when not locked to permit manual positioning of the screen 50 between the extended and retracted positions.

The motor 63 may be controlled by a control panel 70 that extends from one of the upright members 21 and in communication with the motor 63. The control panel 70 has one or more of the following control buttons: raising button 71, a lowering button 72, and a locking button 73. The raising button 71 is for selectively rotating the spool 61 in the second direction. The lowering button 72 is for selectively rotating the spool 61 in the first direction. The locking button 73 is for selectively locking the motor 63 from rotation such that the spool 61 is prevented from rotation. A power cord 64 is in communication with the control panel 70 and is adapted for coupling with a power source.

The motor 63 may also be controlled by a remote controller 74 in communication with the motor 63 such as by infrared light or radio waves. The remote controller 74 has one or more of the following buttons: a raising button 75, a lowering button 76, and a locking button 77. The raising button 75 is for selectively rotating the spool 61 in the second direction. The lowering button 76 is for selectively rotating the spool 61 in the first direction. The locking button 77 is for selectively locking the motor 63 from rotation such that the spool 61 is prevented from rotation.

Figure 5:
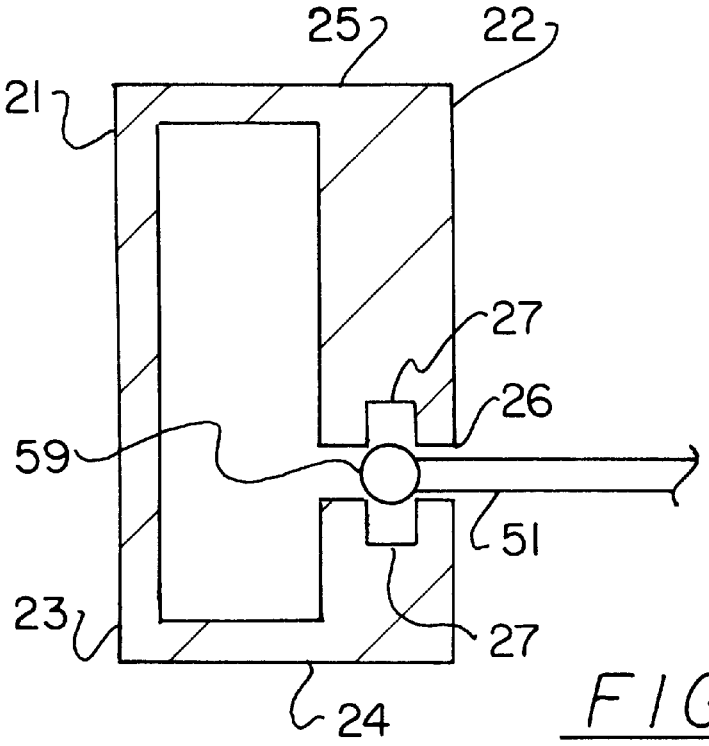
FIG. 5 is a schematic cross sectional view of the present invention taken from line 5—5 of FIG. 1.
Figure 6:
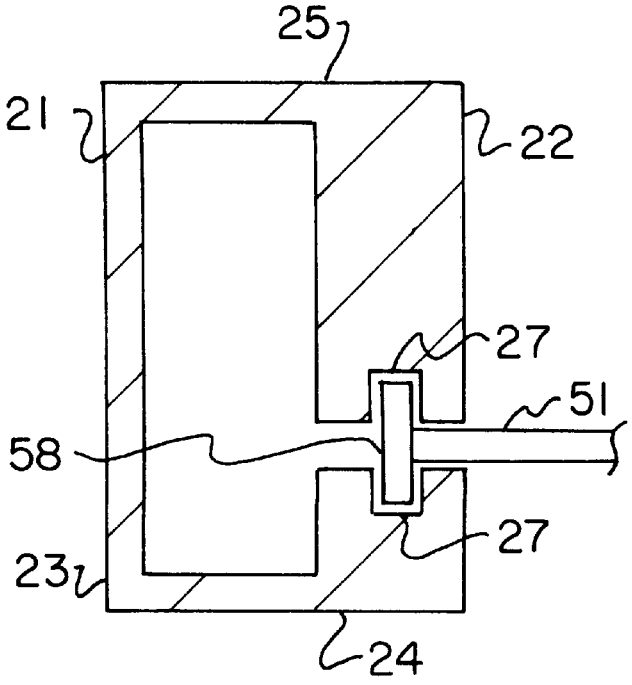
FIG. 6 is a schematic cross sectional view of the present invention taken from line 6—6 of FIG. 3.

Preferably, as illustrated in FIGS. 5 and 6, each of the front and back sides 24,25 of the upright members 21 has a channel 27 extending therein from the interior of each of the upright members 21. The channels 27 extend between the upper and lower ends 28,29 of the upright members 21. The channels 27 of a respective upright member oppose each other to form a track therebetween.

As shown in FIGS. 3 and 5, the bottom end 53 of the screen 50 has a rod 57 extending therealong and through the guide slots 26 of the upright members 21. The rod 57 has opposed ends. Each of the ends of the rod 57 has a roller 58 rotatably coupled thereto. Each of the rollers 58 is disposed in a track.

Also preferably, as shown in FIG. 6, each of the side ends 51 of the screen 50 has a securing flange 59 extending therealong between the top and bottom ends 52,53 of the screen 50 to help prevent the side ends 51 of the screen 50 from becoming removed from the guide slots 26. Ideally, each of the securing flanges 59 has a generally circular transverse cross section.

The screen assembly 10 may further comprise a generally rectangular window sill (not shown) that has an inner periphery and an outer periphery. The outer periphery of the window sill is adapted for coupling to a structure. The frame 20 is coupled to the inner periphery of the window sill. Alternatively, the screen assembly further comprises a generally rectangular door frame 20 (not shown) that has an inner periphery and an outer periphery. The outer periphery of the door frame 20 is adapted for coupling to a structure. The frame 20 is coupled to the inner periphery of the door frame 20.

In use, the handle 54 is manipulated to position the screen 50 between the extended and retracted positions. Alternatively, the buttons of the control panel 70 or the remote controller 74 58 are manipulated to position the screen 50 between the extended and retracted positions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A screen assembly comprising, in combination:

a generally rectangular window sill having all inner periphery and an outer periphery, said outer periphery of said window sill being adapted for coupling to a structure;

a generally rectangular frame being coupled to said inner periphery of said window sill, said frame having a pair of upright members, an upper cross member extending between tipper ends of said upright members, and a lower cross member extending between lower ends of said upright members;

each of said upright members having inner and outer sides, front and back sides, and an interior being defined between said sides, each of said inner sides of said upright members having a guide slot being extended therethrough between said tipper and lower ends of said upright members, each of said guide slots being positioned towards said front sides of said upright members;

a flexible screen extending downwardly from said upper cross member, opposed side ends of said screen being slidably disposed in said guide slots, said screen having top and bottom ends, said screen having a plurality of apertures therethrough for permitting air flow through said screen;

said screen being positionable between an extended position and a retracted position, said bottom end of said screen being positioned towards said lower cross member when said screen is positioned in said extended position, said bottom end of said screen being positioned towards said upper cross member when said screen is positioned in said retracted position;

said screen comprising a projectile energy absorbing material, said material comprising interwoven high strength synthetic fibers;

said bottom end of said screen having a handle being coupled thereto;

said bottom end of said screen having a latch mechanism coupled thereto for latching to said lower cross member;

said latch mechanism having a hook extending therefrom, said lower cross member having a flange, said hook of said latch mechanism selectively engaging said flange of said lower cross member for latching said screen to said lower cross member;

said upper cross member having top and bottom sides, forward and rearward sides, and an interior being defined between said sides, said bottom side of said upper cross member having a lower slot extending therethrough between opposite ends thereof, said lower slot being positioned towards said forward side of said upper cross member, said screen slidably extending through said lower slot;

a retracting mechanism being disposed in said upper cross member, said retracting mechanism being for storing said screen when said screen is in said retracted position;

said retracting mechanism comprising a generally cylindrical spool being rotatably disposed in said upper cross member, said top end of said screen being coupled to said spool, said screen wrapping around said spool as said screen moves from an extended position towards a retracted position;

said spool being rotatable in a first direction and a second direction, said spool moving in said first direction as said screen moves towards an extended position, said spool moving in a second direction as said spool moves towards a retracted position;

said spool being biased towards said second direction;

said retracting mechanism further comprising a motor being operatively coupled to said spool, said motor being for rotating said spool in said first and second directions;

each of said front and back sides of said upright members having a channel extending therein from said interior of each of said upright members, said channels being extended between said upper and lower ends of said upright members, said channels of a respective upright member opposing each other to form a track therebetween;

said bottom end of said screen having a rod extending therealong and through said guide slots of said upright members;

said rod having opposed ends, each of said ends of said rod having a roller rotatably coupled thereto, each of said rollers being disposed in a track; and each of said side ends of said screen having a securing flange extending therealong between said top and bottom ends of said screen, each of said securing flanges having a generally circular transverse cross section.

2. A screen assembly comprising, in combination:

a generally rectangular door frame having an inner periphery and an outer periphery, said outer periphery of said door frame being adapted for coupling to a structure;

a generally rectangular frame being coupled to said inner periphery of said door frame, said frame having a pair of upright members, an upper cross member extending between upper ends of said upright members, and a lower cross member extending between lower ends of said upright members;

each of said upright members having inner and outer sides, front and back sides, and an interior being defined between said sides, each of said inner sides of said upright members having a guide slot being extended therethrough between said upper and lower ends of said upright members, each of said guide slots being positioned towards said front sides of said upright members;

a flexible screen extending downwardly from said upper cross member, opposed side ends of said screen being slidably disposed in said guide slots, said screen having top and bottom ends, said screen having a plurality of apertures therethrough for permitting air flow through said screen;

said screen being positionable between an extended position and a retracted position, said bottom end of said screen being positioned towards said lower cross member when said screen is positioned in said extended position, said bottom end of said screen being positioned towards said upper cross member when said screen is positioned in said retracted position;

said screen comprising a projectile energy absorbing material, said material comprising interwoven high strength synthetic fibers;

said bottom end of said screen having a handle being coupled thereto;

said bottom end of said screen having a latch mechanism coupled thereto for latching to said lower cross member;

said latch mechanism having a hook extending therefrom, said lower cross member having a flange, said hook of said latch mechanism selectively engaging said flange of said lower cross member for latching said screen to said lower cross member;

said upper cross member having top and bottom sides, forward and rearward sides, and an interior being defined between said sides, said bottom side of said upper cross member having a lower slot extending therethrough between opposite ends thereof, said lower slot being positioned towards said forward side of said upper cross member, said screen slidably extending through said lower slot;

a retracting mechanism being disposed in said upper cross member, said retracting mechanism being for storing said screen when said screen is in said retracted position;

said retracting mechanism comprising a generally cylindrical spool being rotatably disposed in said upper cross member, said top end of said screen being coupled to said spool, said screen wrapping around said spool as said screen moves from an extended position towards a retracted position;

said spool being rotatable in a first direction and a second direction, said spool moving in said first direction as said screen moves towards an extended position, said spool moving in a second direction as said spool moves towards a retracted position;

said spool being biased towards said second direction;

said retracting mechanism further comprising a motor being operatively coupled to said spool, said motor being for rotating said spool in said first and second directions;

each of said front and back sides of said upright members having a channel extending therein from said interior of each of said upright members, said channels being extended between said upper and lower ends of said upright members, said channels of a respective upright member opposing each other to form a track therebetween;

said bottom end of said screen having a rod extending therealong and through said guide slots of said upright members;

said rod having opposed ends, each of said ends of said rod having a roller rotatably coupled thereto, each of said rollers being disposed in a track; and each of said side ends of said screen having a securing flange extending therealong between said top and bottom ends of said screen, each of said securing flanges having a generally circular transverse cross section.

* * * * *